US010465510B2

(12) United States Patent
Baudoin

(10) Patent No.: US 10,465,510 B2
(45) Date of Patent: Nov. 5, 2019

(54) ROTOR CATCH APPARATUS FOR DOWNHOLE MOTOR AND METHOD OF USE

(71) Applicant: KLX Inc., Wellington, FL (US)

(72) Inventor: Toby Scott Baudoin, Rayne, LA (US)

(73) Assignee: KLX Energy Services, LLC, Houston, TX (US)

( * ) Notice: Subject to any disclaimer, the term of this patent is extended or adjusted under 35 U.S.C. 154(b) by 68 days.

(21) Appl. No.: 15/621,125

(22) Filed: Jun. 13, 2017

(65) Prior Publication Data

US 2017/0356289 A1 Dec. 14, 2017

Related U.S. Application Data

(60) Provisional application No. 62/349,215, filed on Jun. 13, 2016.

(51) Int. Cl.

| | |
|---|---|
| ***E21B 47/09*** | (2012.01) |
| ***E21B 49/00*** | (2006.01) |
| ***E21B 21/10*** | (2006.01) |
| ***E21B 31/00*** | (2006.01) |
| *E21B 4/02* | (2006.01) |
| *E21B 19/10* | (2006.01) |
| *E21B 21/08* | (2006.01) |

(52) U.S. Cl.

CPC ..... *E21B 49/003* (2013.01); *E21B 21/103* (2013.01); *E21B 31/005* (2013.01); *E21B 47/091* (2013.01); *E21B 4/02* (2013.01); *E21B 19/10* (2013.01); *E21B 21/08* (2013.01)

(58) Field of Classification Search

CPC ... E21B 4/02; E21B 7/24; E21B 28/00; E21B 31/005; E21B 47/187

See application file for complete search history.

(56) References Cited

U.S. PATENT DOCUMENTS

| | | | | |
|---|---|---|---|---|
| 6,279,670 | B1 | 8/2001 | Eddison | |
| 8,181,719 | B2 | 5/2012 | Bunney | |
| 9,194,181 | B2 | 11/2015 | Connell | |
| 2011/0073374 | A1* | 3/2011 | Bunney | E21B 4/02 175/107 |
| 2014/0060936 | A1* | 3/2014 | Connell | E21B 21/103 175/107 |
| 2015/0107857 | A1* | 4/2015 | Mosing | E21B 19/07 166/382 |
| 2016/0032703 | A1* | 2/2016 | Broussard | E21B 43/26 166/250.01 |

* cited by examiner

*Primary Examiner* — Nicole Coy
*Assistant Examiner* — Dany E Akakpo
(74) *Attorney, Agent, or Firm* — Duane Morris LLP

(57) ABSTRACT

A rotor catch assembly for connection in a workstring in a wellbore is provided. The rotor catch assembly is connected to a downhole motor assembly that includes a rotor that is driven by a fluid. In the normal operating state of the rotor catch assembly, fluid flows through the catch assembly and causes the rotor to rotate. In this state, the catch assembly generates pressure pulses in the fluid in the workstring to facilitate advancement of the workstring in the wellbore. In the event of a failure of a mechanical connection in the motor assembly, the rotor catch assembly shifts to a catch-activated state in which the motor assembly is disabled.

20 Claims, 4 Drawing Sheets

ROTOR CATCH APPARATUS FOR DOWNHOLE MOTOR AND METHOD OF USE

CROSS-REFERENCE TO RELATED APPLICATIONS

This application claims the benefit of U.S. Provisional Patent Application No. 62/349,215, entitled "Rotor Catch Apparatus for Downhole Motor and Method of Use," filed on Jun. 13, 2016, which is hereby expressly incorporated herein by reference in its entirety.

FIELD

The present disclosure relates generally to downhole apparatuses and, more particularly, to a rotor catch assembly for retrieving a downhole motor assembly from a wellbore.

BACKGROUND

Traditionally, earthen boreholes for oil and gas production, fluid injection, etc., frequently referred to as "wells," are drilled by rotating a drillstring from the drilling rig, by means of a rotary table and kelly. The drill bit on the lowermost end of the drillstring is in turn rotated, and with the addition of weight applied to the drill bit by drill collars and other components of the drillstring, drilling takes place.

An alternative way of rotating the drill bit is by use of a downhole device, either a downhole motor, such as a positive displacement motor (frequently called a Moineau motor) or a downhole turbine. A "downhole motor." as used herein, encompasses any arrangement that generates rotation of a tool (e.g., a drill bit) and which is positioned downhole in a workstring (e.g., a drillstring). Generally, when a downhole motor is used, the workstring is not rotated. However, in some implementations, the workstring can be rotated slowly to reduce drag on the workstring caused by friction with the wellbore. Downhole motors utilize circulation of a fluid (e.g., drilling fluid, "mud," or in some cases gas), down through the workstring and through the downhole motor, to generate rotation. Downhole motors are also used in settings other than conventional drilling, for example with coiled tubing, or workstrings used in well cleanout work and the like.

On occasion, circumstances can arise which cause a lower section of the downhole motor, referred to as the bearing assembly, to become separated from an upper section of the downhole motor, referred to as the power section. This separation may be caused by mechanical failure or by a threaded connection becoming unthreaded, also referred to as "backing off." A threaded connection generally can fail or back off after a stall has occurred in a downhole motor.

As an example, during performance of a downhole operation, the downhole motor may stall. When this occurs, the pressure of the circulated fluid increases, alerting the operator of a problem. To address the issue, the operator typically will reduce or eliminate the amount of downward weight by lifting the workstring or coil tubing string. However, if the motor comes out of the stall very suddenly, reaction forces generated can cause a threaded connection to become loose and back off. Once this occurs, the bearing assembly with the rotor separates from the stator of the power section and will remain in the hole. This necessitates a retrieval operation, known as "fishing," to remove the bearing assembly and rotor from the wellbore. Because fishing is a very expensive and time consuming process, it should be avoided if possible. Moreover, using a fishing technique to fish a motor from the wellbore can be challenging because rotors typically are helically fluted and hard-chrome coated, making them difficult to latch onto with conventional fishing tools.

SUMMARY

The following introduces a selection of concepts in a simplified form in order to provide a foundational understanding of some aspects of the present disclosure. The following is not an extensive overview of the disclosure, and is not intended to identify key or critical elements of the disclosure or to delineate the scope of the disclosure. The following merely presents some of the concepts of the disclosure as a prelude to the more detailed description provided thereafter.

According to an embodiment, a rotor catch assembly for use with a workstring and a downhole motor assembly deployed in a wellbore is provided. The downhole motor assembly includes a stator housing and a rotor rotatable in the stator housing responsive to a flow of fluid in the workstring The rotor catch assembly comprising a tubular housing to connect between the workstring and the downhole motor assembly. The housing has a longitudinal throughbore to permit passage of a fluid from the workstring to the downhole motor assembly. The catch assembly also includes a rotor shaft that is supported in the tubular housing to engage and rotate with the rotor of the downhole motor assembly. The rotor shaft is axially moveable in the throughbore from an operating position, in which the fluid drives the downhole motor assembly, to a catch-activated position, in which the rotor shaft substantially blocks flow of the fluid to the downhole motor assembly. The catch assembly further includes a variable size fluid port disposed in the throughbore to variably restrict the flow of the fluid to the downhole motor assembly while the rotor shaft is in the operating position. Rotation of the rotor shaft varies the size of the variable size flow port, thereby generating pressure pulses in the flow of the fluid upstream of the downhole motor assembly.

In another embodiment, a motor and rotor catch assembly comprises a motor comprising a stator housing and a rotor supported in the stator housing for rotational movement in response to a flow of fluid in the stator housing, and a tubular housing connected to the motor and providing a passageway for fluid to flow to the stator housing. The assembly further includes a rotor shaft connected to the rotor and supported in the tubular housing for rotational movement relative to the housing is substantially prevented and for axial movement from an operating position to a catch-activated position. The tubular housing and the rotor shaft are configured such that when the rotor shaft is in the operating position and rotating relative to the slidable tubular member, a flow area in the passageway is varied to generate pulses in the fluid that flows to the motor, and when the rotor shaft is in the catch-activated position, the rotor shaft substantially blocks fluid flow to the motor.

A method of operating a downhole motor assembly connected to a workstring in a wellbore also is provided, where the downhole motor assembly comprises a stator housing and a rotor supported in the stator housing for rotational movement in response to a flow of fluid in the stator housing pumped through the workstring. The method comprises deploying the workstring in the wellbore, where the workstring is coupled to a rotor catch assembly that is coupled to the downhole motor assembly. The rotor catch assembly comprises a tubular housing providing a passageway for fluid pumped through the workstring to flow to the stator housing, and a rotor shaft connected to the rotor and supported in the tubular housing for rotational movement relative to the housing and for axial movement from an operating position to a catch-activated position. The tubular housing and the rotor shaft are configured such that when the rotor shaft is in the operating position and rotating relative to the slidable tubular member, a flow area in the passageway is varied to generate pulses in the fluid that flows to the motor, and when the rotor shaft is in the catch-activated position, the rotor shaft substantially blocks fluid flow to the motor. The method also includes pumping fluid through the workstring to rotate the rotor of the downhole motor assembly.

Further scope of applicability of the apparatuses and methods of the present disclosure will become apparent from the more detailed description given below. However, it should be understood that the following detailed description and specific examples, while indicating embodiments of the apparatus and methods, are given by way of illustration only, since various changes and modifications within the spirit and scope of the concepts disclosed herein will become apparent to those skilled in the art from the following detailed description.

BRIEF DESCRIPTION OF THE DRAWINGS

These and/or other aspects will become apparent and more readily appreciated from the following description of the embodiments, taken in conjunction with the accompanying drawings of which.

The headings provided herein are for convenience only and do not necessarily affect the scope or meaning of what is claimed in the present disclosure.

Embodiments of the present disclosure and their advantages are best understood by referring to the detailed description that follows. It should be appreciated that like reference numbers are used to identify like elements illustrated in one or more of the figures, wherein showings therein are for purposes of illustrating embodiments of the present disclosure and not for purposes of limiting the same.

DETAILED DESCRIPTION

Various examples and embodiments of the present disclosure will now be described. The following description provides specific details for a thorough understanding and enabling description of these examples. One of ordinary skill in the relevant art will understand, however, that one or more embodiments described herein may be practiced without many of these details. Likewise, one skilled in the relevant art will also understand that one or more embodiments of the present disclosure can include other features and/or functions not described in detail herein. Additionally, some well-known structures or functions may not be shown or described in detail below, so as to avoid unnecessarily obscuring the relevant description.

Figure 1:
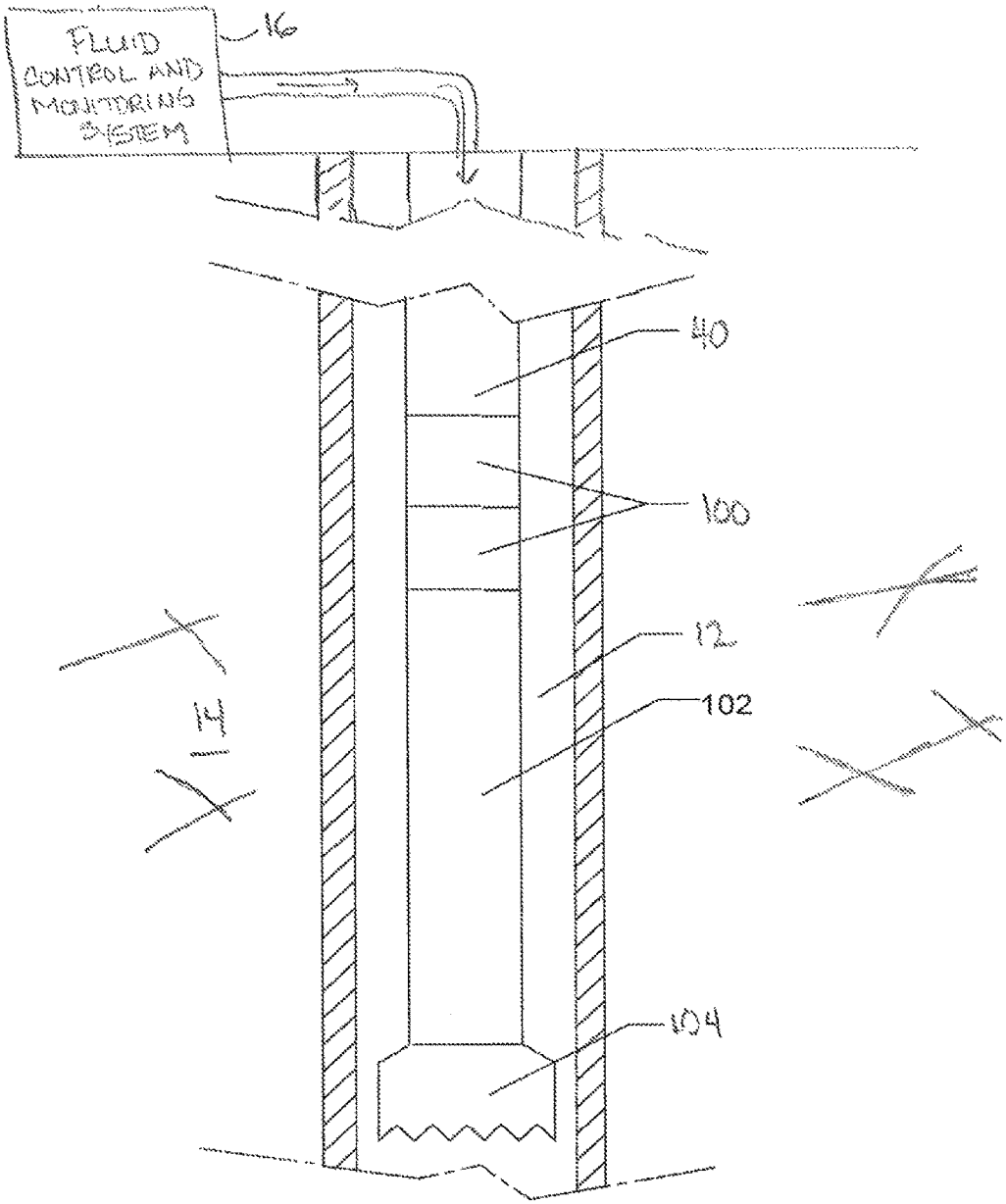
FIG. 1 is a schematic view of system for operating a workstring deployed in a wellbore along with a downhole motor assembly and a rotor catch assembly, according to an embodiment.

Referring now to FIG. 1, a schematic illustration of a system for operating a workstring 40 (e.g., a drillstring) deployed in a wellbore 12 being formed in a subterranean region 14, such as a hydrocarbon producing earth formation, is shown. The workstring 40 carries a rotor catch assembly 100 coupled to a downhole motor assembly 102 which rotates a drill bit 104 to form the wellbore 12. As shown in further detail in FIGS. 13 and 14, the downhole motor assembly 102 can be a mud motor, such as a Moineau positive displacement type, that includes a rotor 110, a stator 115, and a bearing assembly 105. The rotor 110 is a helical fluted metal shaft that is forced to rotate inside of stator 115 by fluid pumped through the workstring 40 by a fluid control and monitoring system 16 at the surface of the wellbore 12. The fluid control and monitoring system 16 can include fluid pumps, control systems for controlling the fluid pump and/or downhole operations, monitoring systems with various sensing devices to monitor the operation being performed in the wellbore 12, such as a pressure sensor to monitor the pressure of the fluid circulating in the workstring 40, etc.

Referring again to FIGS. 13 and 14, the stator 115 of the downhole motor assembly 102 is connected to the workstring 40 and is generally a metal tube lined with rubber containing internal helical flutes similar to those of rotor 110. The combination of the rotor 110 and stator 115 is often referred to as a "power section" as it transfers fluid energy from the fluid into mechanical rotation.

The bearing assembly 105 attaches to the lower end of the power section. The bearing assembly 105 takes thrust loads in both axial directions as well as radial and torsional loads and thus includes both thrust and radial bearings of some form. Various types of bearing assemblies are well known to those of skill in the art and are prevalently used in the industry.

The drill bit 104 (FIG. 1) is attached to the lower end of the bearing assembly 105. In operation, torsional loads are transferred from the rotor 110, through the bearing assembly 105 inner mandrel to the drilling bit 104. However, situations can occur that can cause the downhole motor assembly 102 to stall. In general, a stall occurs when the torque required for the operation exceeds the torque output or abilities of the downhole motor assembly 102 and, thus, rotation of the drill bit 104 halts. When a stall occurs, a great amount of rotational potential energy is stored within the downhole motor assembly 102. If this potential energy is released, torsional forces are generated that can cause a threaded connection in the downhole motor assembly 102 to back off or fail.

When a stall occurs, the control and monitoring system 16 will detect an increase in fluid pressure, thus alerting the operator to a problem with the drilling operation. Typically, the operator responds to the pressure increase by lifting the drillstring 40 in order to reduce the downward weight. However, if the operator lifts the drillstring 40 too quickly or prior to discontinuing pumping of the drilling fluid, the potential energy stored in the downhole motor assembly 102 is suddenly released. The release in potential energy can, in turn, cause a failure of a threaded connection (e.g., a mechanical failure of the threads, a back off of the threads, etc.) of the downhole motor assembly 102, creating a situation where the assembly 102 is left in the wellbore 12 and must be retrieved.

The rotor catch assembly 100 facilitates retrieval of the drilling motor assembly 102 in a failure situation and thus avoids the use of conventional fishing tools. Fishing tools typically operate via a retrieval feature that can engage or latch with a feature of the device that has been left downhole. Retrieval of drilling motor assemblies using conventional tools can be challenging because the rotors typically are helically fluted and hard chrome coated and thus do not have a surface feature that can be readily latched.

Figure 2:
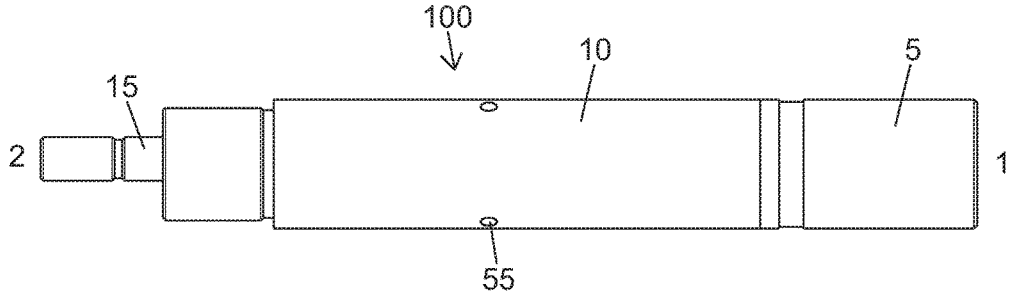
FIG. 2 is an elevation view of a rotor catch assembly, according to an embodiment.

Turning now to FIG. 2, an elevational view of an exemplary rotor catch assembly 100 is shown, according to an embodiment. As shown, the rotor catch assembly 100 includes a top sub-component (or sub) 5, a bottom sub 10, and a shaft 15. The assembly 100 extends between a first end 1, which can be the "upper" (for ease of reference) end when deployed in a wellbore, and a second end 2, which can be the "lower" (again, for ease of reference) end when deployed in a wellbore. The first end 1 is configured to couple with a drillstring, toolstring workstring or coiled tubing string, such as the string 40 in FIG. 1. The lower end 2 is configured to couple with a downhole motor assembly, such as the assembly 102 of FIG. 1.

In the embodiment shown, the assembly 100 also includes one or more fluid bypass ports 55. The ports 55 extend through a sidewall of the sub 10 and, as will be further described below, provide a bypass pathway for fluid to exit from an internal throughbore 65 of the assembly 100 in order to disable the motor assembly 102 during a failure condition. In other embodiments, ports 55 and the bypass pathway can be omitted. Or, if a bypass path is provided, the bypass path can be implemented through a different arrangement of ports or fluid flow paths than those illustrated in the Figures.

Figure 3:
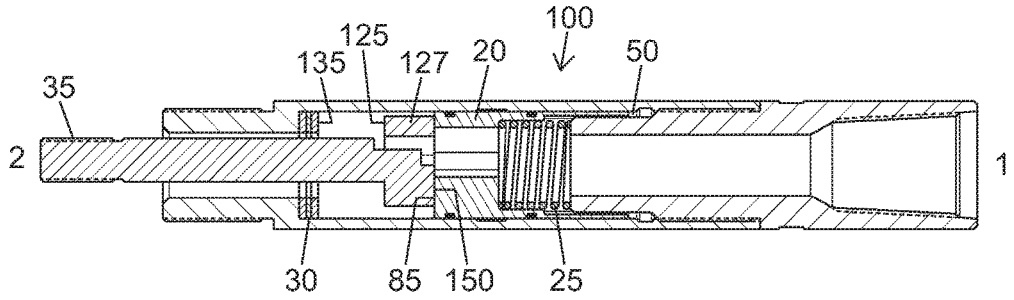
FIG. 3 is a sectional view of a rotor catch assembly in the normal operating state, according to an embodiment.

A cross-sectional view of an elevation of an example of a rotor catch assembly 100 is shown in FIG. 3. In this embodiment, the top sub 5 and the bottom sub 10 are threadedly attached to form a tubular housing having longitudinal throughbore 65 to provide a passage for fluid to flow (e.g., drilling fluid). For example, drilling fluid pumped through drillstring 40 connected to the end 1 of assembly 100 flows through the throughbore 65 and to a downhole motor assembly 102 connected to the assembly 100 at the end 2. The shaft 15 also is supported by the housing formed by subs 5 and 10, and is positioned within the bore 65. As shown, the shaft 15 projects from the bottom sub 10 so that it can attach to a downhole motor assembly 102, such as to the rotor 110 of the assembly 102.

Figure 5:
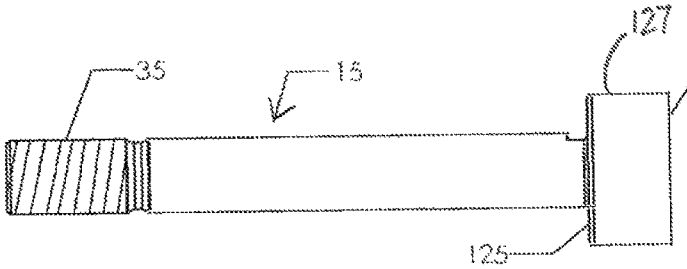
FIG. 5 is an elevation view of a rotor shaft of a rotor catch assembly, according to an embodiment.
Figure 6:
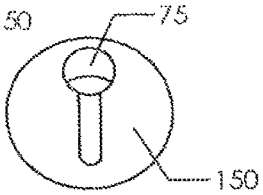
FIG. 6 is an end view of an upper end of the shaft of FIG. 5, according to an embodiment.

FIG. 5 depicts a side elevational view of an embodiment of an example of the shaft 15. In this embodiment, shaft 15 extends between a first end having threads 35 for attachment to the upper end of rotor 110 and a second end having an enlarged portion 127 (e.g., an annular portion with a diameter greater than the shaft 15). FIG. 6 depicts an end view taken from the right side of the view of the shaft 15 of FIG. 5, which is the upper end of the shaft when the assembly 100 is deployed downhole. FIG. 6 shows a fluid aperture 75 that extends between a face 150 and a face 125 of the enlarged annular portion 127. The fluid aperture 75 will be described in further detail below.

Returning to FIG. 3, an axially movable or slidable member 20 (e.g., a piston, a sleeve valve), a spring 25 and thrust bearings 30 also are contained within the tubular housing of the catch assembly 100. The piston 20 is connected to the top sub 5 via a fixation device 50. The fixation device 50 is configured to prevent relative rotation between the top sub 5 and piston 20, but still allow for axial movement. In an embodiment, the fixation device 50 is a male hex connector that engages with an internal hex 90 on piston 20. In other embodiments, this arrangement can be reversed and the male hex connector can be on the piston 20 and the internal hex can be part of the sub 5. As would be recognized by one skilled in the art, other connection configurations also can be used to prevent relative rotation while allowing axial movement of the piston 20, such as splines, keyways, pins, other shapes such as ovals, etc.

Figure 7:
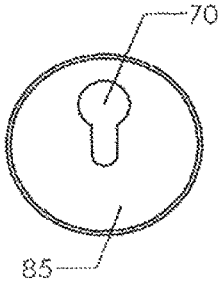
FIG. 7 is an end view of a lower end of the piston of FIG. 8, according to an embodiment.
Figure 8:
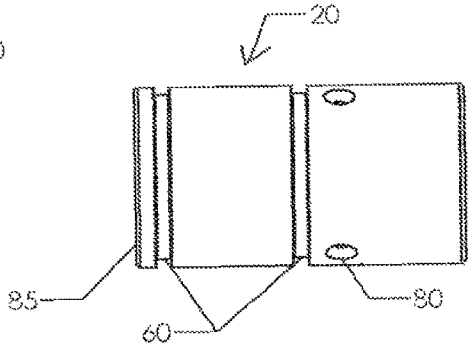
FIG. 8 is an elevation view of a piston of a rotor catch assembly, according to an embodiment.
Figure 9:
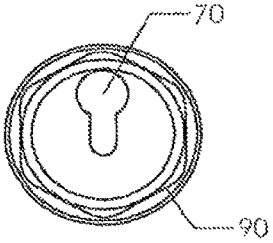
FIG. 9 is an end view of the upper end of the piston of FIG. 8, according to an embodiment.

An example of an embodiment of the piston 20 is shown in FIGS. 7, 8 and 9. FIG. 8 is a side elevation of the piston 20, FIG. 7 is an end view seen from the left side of the piston 20 in FIG. 8 (the lower end when deployed in a wellbore), and FIG. 9 is an end view seen from the right side of the piston 20 in FIG. 8 (the upper end when deployed in a wellbore). FIG. 7 shows a face 85 of piston 20 having a fluid aperture 70 extending therethrough. The fluid aperture 70 will be further described below. FIG. 9 shows the internal hex connector 90 that engages with the complementary hex fitting 50 on the top sub 5. As can best be seen in FIG. 8, piston 20 also includes seals 60 to substantially prevent fluid flowing between the exterior surface of piston 20 and the interior bore of bottom sub 10. The seals 60 prevent fluid that is pumped through the workstring 40 and through the rotor catch assembly 100 from exiting through fluid bypass port(s) 80 in piston 20 and then through fluid port(s) 55 in bottom sub 10 when the assembly 100 is in the normal operating state in which motor 102 is running.

Figure 13:
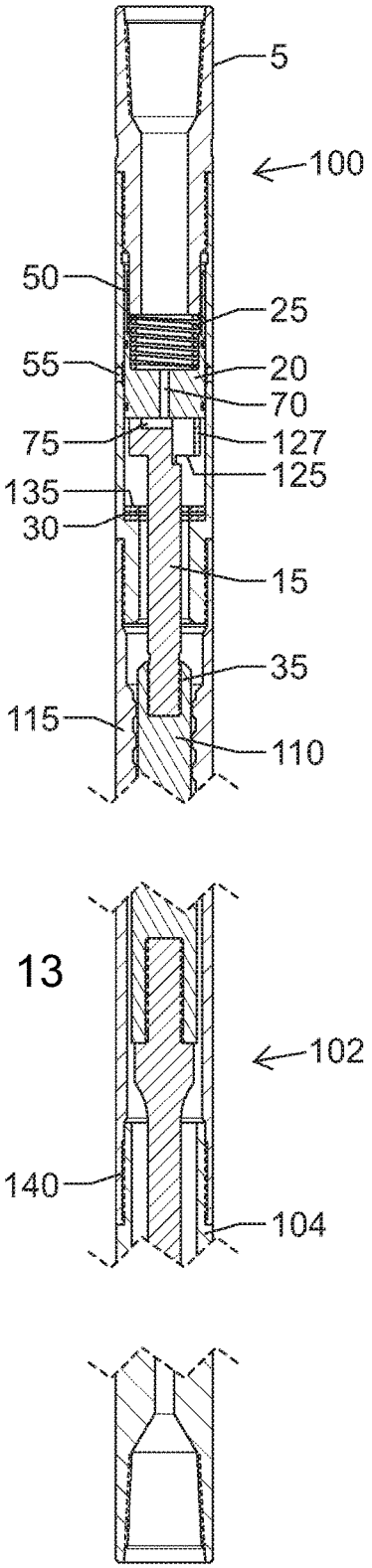
FIG. 13 is a sectional view of the rotor catch assembly threadedly attached to a downhole motor assembly in the normal operating state, according to an embodiment.
Figure 14:
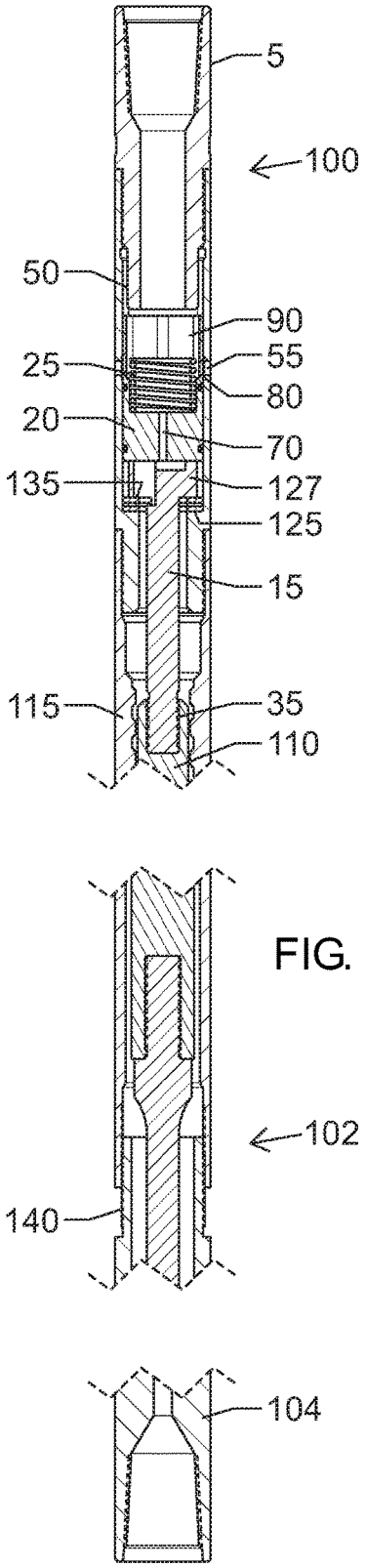
FIG. 14 is a sectional view the rotor catch assembly threadedly attached to a downhole motor assembly in the shifted or catch-activated state, according to an embodiment.

The normal operating state of assembly 100 is shown in FIGS. 3 and 13. "Normal," in this context, means that an operating condition of the workstring 40 in which the downhole motor assembly 102 is running and the rotor is rotating. Conversely, an "activated" or "catch-activated" state of the assembly 100 occurs in response to a failure, including a backing off, of a mechanical connection of the downhole motor assembly 102. The catch-activated condition is shown in FIGS. 4 and 14, and will be described in further detail below.

FIG. 3 illustrates the rotor catch assembly 100 in the normal operating state in which the rotor shaft 15 is in an operating position. As shown, the lower face 85 of piston 20 abuts the upper face 150 of shaft 15, forming a metal-to-metal seal. Faces 85 and 150 can be coated with a wear resistant material, such as ceramics or carbides, or the faces 85, 150 can be heat treated. Faces 85 and 150 also can be polished to reduce friction as shaft 15 rotates relative to piston 20. In this position, fluid flows through the catch assembly 100 from end 1 to end 2.

Figure 4:
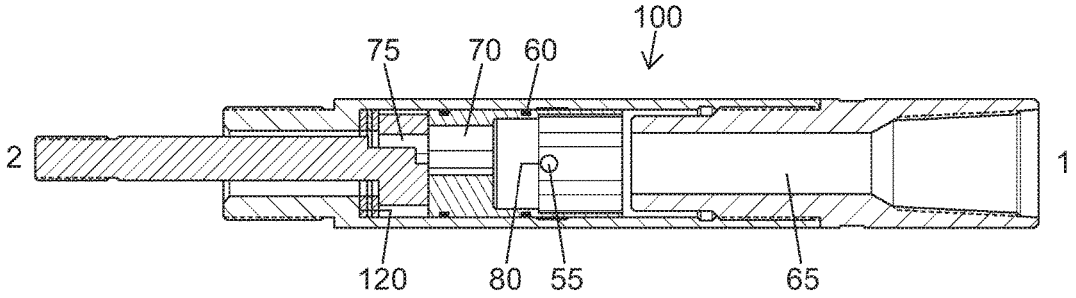
FIG. 4 is a sectional view of a rotor catch assembly in the shifted or catch-activated state, according to an embodiment.

FIG. 4 illustrates the rotor catch assembly 100 in the activated state in which the rotor shaft 15 has moved axially to a catch-activated position. In this position, the enlarged annular portion 127 of shaft 15 abuts a narrowed region in the throughbore 65 that stops further movement of shaft 15 and blocks fluid flow, thus disabling the motor assembly 102. For example, in the embodiment shown in FIG. 4, face 125 of enlarged portion 127 abuts a shoulder or face 120 of bottom sub 10 through thrust bearings 30. Bearings 30 can be of various forms such as plain bearings, ball or roller bearings, polycrystalline diamond compact (PDC) bearings, etc. In the embodiment shown, thrust bearings 30 eliminate wear on face 120 of bottom sub 10 and face 125 of shaft 15 upon activation of the rotor catch assembly 100, as illustrated in FIGS. 4 and 14. In other embodiments, thrust bearings 30 can be omitted.

Spring 25 also can be omitted in various embodiments. In the embodiment shown in FIG. 3, spring 25 provides a pre-load on piston 20 so that piston 20 is biased downwardly (i.e., towards end 2 of assembly 100), when the assembly 100 is activated. Although FIG. 4 shows the activated state of the embodiment of the assembly 100 of FIG. 3, the spring 25 has been removed from the drawing simply for clarity.

The rotor catch assembly 100 is activated (i.e., shaft 15 and piston 20 shift downward towards end 2) when a downhole motor connection failure occurs, such as a back off. As shown in FIG. 14, a connection failure typically occurs at the threaded connection 140 between the lower end of stator 115 and upper end of bearing assembly 105. When a connection failure occurs, threaded connection 140 unscrews partially. In the embodiment shown, the catch assembly 100 is configured to prevent complete disengagement of the threaded connection, a feature that can significantly increase the success rate of rotor catch apparatus 100. To that end, as shown in FIGS. 4 and 14, upon activation of assembly 100, shaft 15 and piston 20 move downward (i.e., toward end 2) until face 125 of shaft 15 contacts face 135 of thrust bearings 30 (or, in embodiments in which bearings 30 are omitted, face 120 of bottom sub 10). When the shaft 15 shoulders out against face 135 (or face 120), the shaft 15 substantially blocks the flow of fluid to the downhole motor 102. At the same time, the axial movement of piston 20 enables a fluid path where circulating fluid is diverted through fluid bypass port(s) 80 of piston 20 and then through fluid bypass port(s) 55 of bottom sub 10 and into the wellbore 12. In this shifted or catch-activated position, the vast majority of the circulated fluid exits the rotor catch assembly 100, thus disabling the downhole motor assembly 102 so that no further disruption of the threaded connection 140 can occur.

When the fluid exits the catch assembly 100, the monitoring system 16 at the surface will indicate to the operator that there is a reduction in fluid pressure. In addition, the operator will have no ability to drill, and thus will be forced to pull the workstring 40 out of the wellbore 12. Once the workstring 40 is on surface, the operator can see that there was a back off or connection failure of connection 140 and can then replace the downhole motor assembly 102. The rotor catch apparatus 100 thus can eliminate or greatly reduce the potential for leaving parts of the downhole motor assembly 102 in the wellbore 12, saving time consuming and expensive fishing operations.

In embodiments, the rotor catch assembly 100 also is configured to generate pressure pulses in the circulating fluid while a downhole operation is being performed. These pressure pulses vibrate the workstring 40 so that static friction between the workstring 40 and the wellbore 12 can be reduced, thus facilitating advancement of the string 40 during downhole operations. To that end, the assembly 100 includes an arrangement of fluid apertures that cooperate to vary a flow area in the fluid passageway through the assembly 100 as the rotor 110 in downhole motor assembly 102 rotates, thus pulsing the fluid that is circulating in the workstring 40. In embodiments, the fluid aperture arrangement includes the fluid aperture 75 in the shaft 15 operating in conjunction with the fluid aperture 70 of the piston 20.

For example, with reference again to FIGS. 5-9, during normal operation of the workstring 40, piston 20 is held stationary with top sub 5 via hex 90. That is, hex 90 of piston 20 substantially eliminates any relative rotation between piston 20 and top sub 5. Thus, while fluid is driving the downhole motor assembly 102 and causing shaft 15 to rotate, the area of the flow passageway through the rotor catch assembly 100 varies as fluid aperture 75 and fluid aperture 70 are at times aligned, partially aligned or not aligned. This variance in fluid aperture alignment causes pressure pulses upstream of the rotor catch assembly 100. The pressure pulses create vibrations in the workstring 40 thereby reducing friction between the workstring 40 and wellbore 12 and facilitating advancement of the string 40 while performing a downhole operation.

Figure 10:
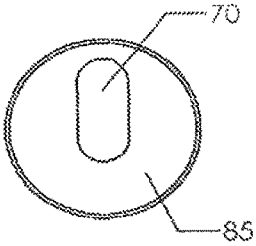
FIG. 10 is an end view of the lower end of the piston of FIG. 8, according to another embodiment.
Figure 11:
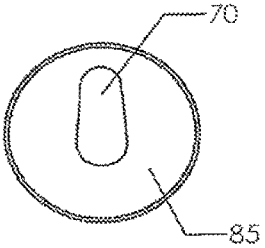
FIG. 11 is an end view of the lower end of the piston of FIG. 8, according to another embodiment.
Figure 12:
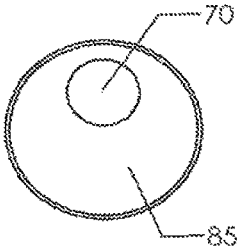
FIG. 12 is an end view of the lower end of the piston of FIG. 8, according to another embodiment.

FIGS. 10-12 illustrate end views of piston 20 showing other embodiments of fluid aperture 70. As shown, fluid apertures 70 can have a variety of shapes, including slots, ovals, holes, etc. These embodiments are mere examples of fluid apertures 70 but can be of any shape or size sufficient to create a flow area that varies as the shaft 15 of rotor catch assembly 100 rotates. Fluid aperture 75 can also be of any shape, size, or number. Any combination of different shapes, sizes or number of fluid apertures 70 and 75 may be used herein. In embodiments, shaft 15 can also contain a bore which can be in communication with fluid aperture 75, extending through connection 35 of shaft 15, which can be in communication with a bore in rotor 110 to provide circulation to the lower end of the downhole motor assembly 102 which will aid in the recovery of said downhole motor assembly 102.

As described above, when in the activated state, the rotor catch assembly 100 enables retrieval of the downhole motor assembly 102 in the event of a failure in the motor's mechanical connection. And, when in the normal operating state, the catch assembly 100 generates pressure pulses in the fluid in the workstring 40 to facilitate advancement of the workstring 40 in the wellbore 12.

For the purposes of promoting an understanding of the principles of the invention, reference has been made to the embodiments illustrated in the drawings, and specific language has been used to describe these embodiments. However, no limitation of the scope of the invention is intended by this specific language, and the invention should be construed to encompass all embodiments that would normally occur to one of ordinary skill in the art. Descriptions of features or aspects within each embodiment should typically be considered as available for other similar features or aspects in other embodiments unless stated otherwise. The terminology used herein is for the purpose of describing the particular embodiments and is not intended to be limiting of exemplary embodiments of the invention.

The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those of ordinary skill in this art without departing from the scope of the invention as defined by the following claims.

Therefore, the scope of the invention is not confined by the detailed description of the invention but is defined by the following claims.

What is claimed is:

1. A rotor catch assembly for use with a workstring and a downhole motor assembly deployed in a wellbore, the downhole motor assembly having a stator housing and a rotor rotatable in the stator housing responsive to a flow of fluid in the workstring, the rotor catch assembly comprising:

a tubular housing to connect between the workstring and the downhole motor assembly, the housing having a longitudinal throughbore to permit passage of a fluid from the workstring to the downhole motor assembly;

a rotor shaft that is supported in the tubular housing to engage and rotate with the rotor of the downhole motor assembly, the rotor shaft axially moveable in the throughbore from an operating position, in which the fluid drives the downhole motor assembly, to a catch-activated position, in which the rotor shaft substantially blocks flow of the fluid to the downhole motor assembly to stop rotation of the rotor; and a fluid port disposed through a terminal endface of the rotor shaft to variably restrict the flow of the fluid to the downhole motor assembly while the rotor shaft is in the operating position, wherein rotation of the rotor shaft varies an amount of fluid flow through the fluid port, thereby generating pressure pulses in the flow of the fluid upstream of the downhole motor assembly.

2. The assembly as recited in claim 1, wherein the rotor shaft extends between a first end that threadedly engages with the rotor of the downhole motor assembly and a second end having an enlarged portion that terminates at the terminal endface, the enlarged portion configured to substantially block the throughbore of the tubular housing when the rotor shaft is in the catch-activated position.

3. The assembly as recited in claim 2, wherein the enlarged portion comprises a shoulder, and wherein axial movement of the rotor shaft to the activated position is stopped when the shoulder abuts a narrowed region in the throughbore.

4. The assembly as recited in claim 1, further comprising:

a piston axially moveable in the throughbore and in mechanical communication with the rotor shaft, the piston having a sidewall defining a longitudinal passageway for the fluid to flow therethrough when the rotor shaft is in the operating position; and a connection member to fixedly engage the piston with the tubular housing to substantially prevent rotational movement of the piston relative to the tubular housing, and wherein the sidewall of the piston terminates at a piston endface that abuts the terminal endface of the rotor shaft so that the rotor shaft can rotate relative to the piston when in the operating position.

5. The assembly as recited in claim 4, further comprising a first fluid aperture that extends through the piston endface, wherein rotation of the rotor shaft varies the amount of fluid flow through the fluid port by varying alignment between the first fluid aperture and the fluid port.

6. The assembly as recited in claim 4, wherein the connection member includes complementary hexagonal connectors to engage the piston with the tubular housing.

7. The assembly as recited in claim 4, wherein the tubular housing further comprises a first bypass fluid port extending through a sidewall of the tubular housing, and wherein the piston further comprises a second bypass fluid port extending through the sidewall of the piston, and wherein axial movement of the piston opens the second bypass fluid port to allow fluid to exit the longitudinal passageway and flow to the exterior of the tubular housing through the first bypass fluid port when the rotor shaft is in the catch-activated position.

8. The assembly as recited in claim 7, further comprising a resilient member to pre-load the piston for axial movement when the rotor shaft moves to the catch-activated position.

9. A motor and rotor catch assembly, comprising:

a motor comprising a stator housing and a rotor supported in the stator housing for rotational movement in response to a flow of fluid in the stator housing;

a tubular housing connected to the motor and providing a passageway for fluid to flow to the motor; and a rotor shaft connected to the rotor and supported in the tubular housing for rotational movement relative to the tubular housing and for axial movement from an operating position to a catch-activated position, the rotor shaft having an enlarged terminal end portion terminating at an endface having a fluid port that extends through the enlarged terminal end portion, wherein the fluid port provides a path in the passageway for fluid to flow to the motor, wherein the tubular housing and the rotor shaft are configured such that when the rotor shaft is in the operating position and rotating relative to the tubular housing, rotation of the rotor shaft varies an amount of fluid flow through the fluid port to generate pulses in the fluid that flows to the motor, and when the rotor shaft is in the catch-activated position, the rotor shaft substantially blocks fluid flow to the motor to stop rotational movement of the rotor.

10. The assembly as recited in claim 9, further comprising:

an axially slidable tubular member in mechanical communication with the rotor shaft and supported in the tubular housing such that rotational movement of the slidable tubular member relative to the rotor shaft is substantially prevented, wherein, when the rotor shaft is in the catch-activated position, the slidable tubular member opens a flow path to divert fluid flow from the passageway to the exterior of the tubular housing through a sidewall of the tubular housing.

11. The assembly as recited in claim 10, wherein the rotor shaft extends between a first end that is threadedly connected to the rotor and a second end that comprises the enlarged terminal end portion, and wherein the enlarged terminal end portion is configured to block a narrowed region of the passageway when the rotor shaft moves to the catch-activated position.

12. The assembly as recited in claim 10, wherein the endface of the enlarged terminal end portion abuts an endface at a terminal end of the slidable tubular member when the rotor shaft is in the operating position.

13. The assembly as recited in claim 12, wherein, when the rotor rotates in response to a fluid flow, a fluid aperture through the endface of the slidable tubular member moves in and out of alignment with the fluid port that extends through the endface of the enlarged terminal end portion of the rotor shaft to vary the amount of fluid flow through the fluid port.

14. The assembly as recited in claim 10, further comprising a resilient member disposed in the tubular housing to pre-load the slidable tubular member for axial movement when the rotor shaft moves to the catch-activated position.

15. The assembly as recited in claim 10, wherein the slidable tubular member comprises:

a sidewall defining a fluid passageway through the tubular member; and a fluid bypass port that extends through the sidewall, wherein, when the rotor shaft is in the catch-activated position, the flow path opened by the slidable tubular member diverts fluid flow from the fluid passageway through the fluid bypass port and to the exterior of the tubular housing through the sidewall of the tubular housing.

16. A method of operating a downhole motor assembly connected to a workstring in a wellbore, the downhole motor assembly comprising a stator housing and a rotor supported in the stator housing for rotational movement in response to a flow of fluid in the stator housing pumped through the workstring, the method comprising:

deploying a workstring in the wellbore, the workstring coupled to a rotor catch assembly that is coupled to the downhole motor assembly, the rotor catch assembly comprising:

a tubular housing providing a passageway for fluid pumped through the workstring to flow to the stator housing; and a rotor shaft connected to the rotor and supported in the tubular housing for rotational movement relative to the tubular housing and for axial movement from an operating position to a catch-activated position, the rotor shaft having an enlarged terminal end portion terminating at an endface with a fluid port formed therethrough, the fluid port providing a path for fluid pumped through the workstring to flow to the stator housing, wherein the tubular housing and the rotor shaft are configured such that when the rotor shaft is in the operating position and rotating relative to the tubular housing, an amount of fluid flow through the fluid port is varied to generate pulses in the fluid that flows to the motor, and when the rotor shaft is in the catch-activated position, the rotor shaft substantially blocks fluid flow to the motor to stop rotational movement of the rotor; and pumping fluid through the workstring to rotate the rotor of the downhole motor assembly.

17. The method as recited in claim 16, wherein the rotor catch assembly further comprises an axially slidable sleeve supported in the tubular housing such that rotational movement of the slidable sleeve relative to the rotor shaft is substantially prevented, and wherein the axially slidable sleeve has an endface that abuts the endface of the enlarged terminal end portion of the rotor shaft when the rotor shaft is in the operating position, and wherein, when the rotor shaft is in the operating position, rotation of the rotor shaft relative to the endface of the sleeve varies the amount of fluid flow through the fluid port.

18. The method as recited in claim 17, wherein, when the rotor shaft is in the catch-activated position, axial movement of the slidable tubular member opens a flow path to divert fluid flow from the passageway to the exterior of the tubular housing.

19. The method as recited in claim 16, further comprising monitoring pressure of the pumped fluid for an indication of a failure of the downhole motor assembly.

20. The method as recited in claim 19, further comprising removing the workstring from the wellbore in response to a decrease in the monitored pressure that is indicative of a failure of the downhole motor assembly.

* * * * *